US007978029B2

(12) United States Patent
Conn

(10) Patent No.: US 7,978,029 B2
(45) Date of Patent: Jul. 12, 2011

(54) MULTIPLE-LAYER SIGNAL CONDUCTOR

(75) Inventor: Robert O. Conn, Hakalau, HI (US)

(73) Assignee: Research Triangle Institute, Research Triangle Park, NC (US)

( * ) Notice: Subject to any disclaimer, the term of this patent is extended or adjusted under 35 U.S.C. 154(b) by 294 days.

(21) Appl. No.: 12/387,873

(22) Filed: May 9, 2009

(65) Prior Publication Data

US 2010/0283559 A1 Nov. 11, 2010

(51) Int. Cl.
*H01P 3/08* (2006.01)

(52) U.S. Cl. ..... 333/238; 333/246

(58) Field of Classification Search ..... 333/238, 333/246, 116, 128, 161, 204
See application file for complete search history.

(56) References Cited

U.S. PATENT DOCUMENTS 2,913,686 A * 11/1959 Fubini et al. ..... 333/238
4,614,922 A * 9/1986 Bauman et al. ..... 333/161
5,712,607 A * 1/1998 Dittmer et al. ..... 333/238
6,552,635 B1 * 4/2003 Sherman et al. ..... 333/238
2005/0237136 A1 * 10/2005 Nakatsuka ..... 333/238
* cited by examiner

*Primary Examiner* — Stephen E Jones
(74) *Attorney, Agent, or Firm* — Imperium Patent Works; T. Lester Wallace; Joseph S. Spano

(57) ABSTRACT

A multiple-layer signal conductor has increased surface area for mitigation of skin effect. Parallel extending elongated strips of conductive material are placed in parallel layers and are separated by a thin layer of dielectric. The elongated strips are conductively connected to one another by regularly spaced vias such that a single signal conductor with multiple conductive layers is formed. During high-speed signaling, the skin effect causes current to concentrate near the surfaces of conductors. The multiple-layer signal conductor, however, has increased surface area with respect to its total cross-sectional area. The effective cross-sectional area which is conductive during high-speed signaling is therefore increased, leading to positive effects on transmission line resistance, heating, signal integrity and signal propagation delay. The multiple-layer signal conductor sees special use on silicon circuit boards and can conduct signals at ten gigahertz or greater for distances of up to five inches without rebuffering or termination.

20 Claims, 9 Drawing Sheets

TYPICAL SIGNAL CONDUCTOR
(CROSS SECTION)

SKIN EFFECT IN TYPICAL SIGNAL CONDUCTOR (CROSS SECTION)

SEMICONDUCTOR SUBSTRATE WITH LONG SIGNAL CONDUCTORS

CROSS-SECTION OF MULTIPLE-LAYER SIGNAL CONDUCTOR

SKIN EFFECT IN MULTIPLE-LAYER SIGNAL CONDUCTOR (CROSS SECTION)

SKIN EFFECT IN MULTIPLE-LAYER SIGNAL CONDUCTOR WITH WIDTH OF 1 MICRON (CROSS SECTION)

CROSS-SECTION OF MULTIPLE-LAYER SIGNAL CONDUCTOR

BREAK DOES NOT SEVER ENTIRE
SIGNAL CONDUCTOR

EMBODIMENT WITH MORE THAN TWO CONDUCTORS

MULTIPLE-LAYER SIGNAL CONDUCTOR

TECHNICAL FIELD

The described embodiments relate to semiconductor processing, and more particularly, to long signal conductors on a silicon substrate.

BACKGROUND INFORMATION

Increasing signaling speeds in circuit boards presents new challenges in signal integrity requirements. A signal conductor with a resistance of ten to twenty ohms at zero hertz may display a much higher effective resistance when the signal transmission speeds reach ten gigahertz or higher. This higher effective resistance comes about due to the phenomenon of skin effect, in which current tends to concentrate at the surface or "skin" of the signal conductor as signal speed increases. With high-speed signaling, the effective cross-sectional area of the signal conductor which is conductive is decreased, leading to increased resistance, heating and signal attenuation.

Signal integrity issues become even more pronounced where high speed signals are driven over signal conductors of increasing length. When the propagation delay through a signal conductor becomes significantly higher than the rise time of the signal, signal reflections that degrade signal integrity appear in the signal conductor as an undershoot or overshoot. With increasing signaling speeds and decreasing rise times, minimizing propagation delay and reflections becomes an issue in maintaining signal integrity.

One method of minimizing propagation delay is to simply minimize the length of signal conductors. FIG. 1 is a simplified block diagram of a typical programmable logic circuit 1 in the prior art. A printed circuit board (PCB) 2 supports four Field-Programmable Gate Array (FPGA) chips 3-6 and two conductive connector circuits 7-8. PCB is less than one inch on a side. Three signal conductors 9-11 supported by the PCB are also illustrated. Signal conductor 9 connects pad 12 at conductive connector circuit 7 and pad 13 at FPGA 3. Signal conductor 10 connects pad 14 at FPGA 3 and pad 15 at FPGA 4. Signal conductor 11 connects pad 16 at conductive connector circuit 7 and pad 17 at FPGA 6. Signal conductors 9-11 conduct signals at speeds of ten gigahertz or greater, with corresponding rise times of around thirty picoseconds.

FIG. 2 is a simplified cross-sectional view of signal conductor 9 of FIG. 1. The cross-sectional view shows example signal conductor 9 supported by the PCB 2. A conductive copper strip 18 has a width of twelve microns and a thickness of two microns. An insulating layer of dielectric 19 separates the conductive copper strip 18 from the PCB 2. An additional layer of dielectric 20 with a thickness greater than that of the conductive copper strip 18 surrounds and covers the conductive copper strip 18.

FIG. 3 is an expanded cross-sectional diagram of the conductive copper strip 18 of FIG. 2 illustrating skin effect at high signal frequencies. Arrows 21 indicate the skin depth at which current concentrates near the upper surface of conductive copper strip 18 during high-speed signaling. Arrows 22 indicate the skin depth at which current concentrates near the lower surface of conductive copper strip 18 during high-speed signaling. Arrows 23 and 24 indicate the skin depth at which current concentrates near the vertical edges of conductive copper strip 18 during high-speed signaling. Patterned area 25 indicates the effective cross-sectional conductive area of the conductive copper strip 18 due to skin effect.

Referring again to FIG. 1, the length of signal conductors 3-6 as illustrated is typically less than twenty millimeters. Where signal transmission lines of twenty or more millimeters in length are required, chip designers will employ techniques such as termination and rebuffering to avoid signal reflections and maintain signal integrity. In some cases, however, it is desirable to drive high-speed signals along signal transmission lines of lengths much greater than twenty millimeters, and without the use of rebuffering or termination. For these longer transmission lines, it is desirable to minimize the increases in resistance due to skin effect. A technique is therefore sought for providing a signal conductor with increased surface area.

SUMMARY

An apparatus and method provides a signal conductor with increased surface area for the mitigation of skin effect. Skin effect causes current to concentrate near the surfaces of conductors during conduction of signals at high frequencies. The increased surface area provided by using multiple layers of conductor in a signaling path increases the effective cross-sectional area which is conductive during high-speed signaling, leading to positive effects on transmission line resistance, heating, signal integrity and signal propagation delay.

With signals of ten gigahertz or greater, current tends to concentrate within six hundred nanometers of the surface of a conductor. Multiple-layer signal conductors can conduct signals at ten gigahertz or greater for distances of up to five inches without rebuffering or termination. Conductors formed of elongated strips of conductive material with a thickness of one micron are placed in parallel layers and separated by thin layers of dielectric on a semiconductor circuit. The elongated strips of conductive material are conductively connected by regularly spaced vias such that a single conductive path with multiple conductive layers is formed. Because each strip of conductive material in the multiple-layer signal conductor has a thickness of one micron, current penetrates to the entire cross-sectional area of the multiple-layer signal conductor despite skin effect.

Further details and embodiments are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Figure 1:
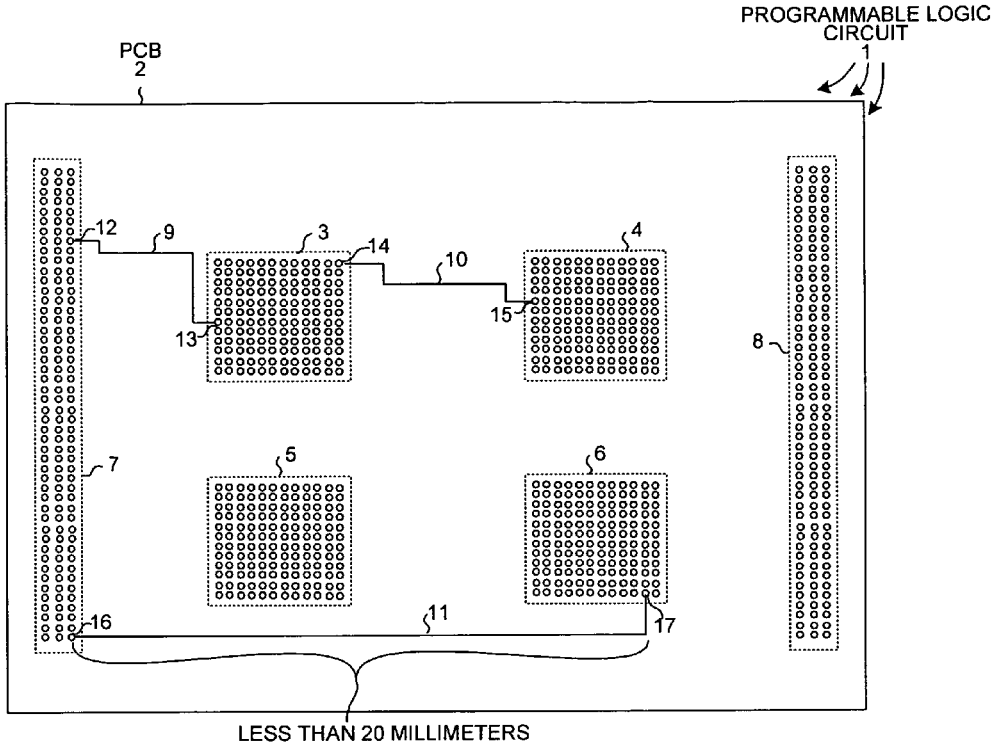
(PRIOR ART) FIG. 1
FIG. 1 is a simplified block diagram of an example printed circuit board (PCB) in the prior art with FPGAs connected by signal conductors of up to twenty millimeters in length.
Figure 2:
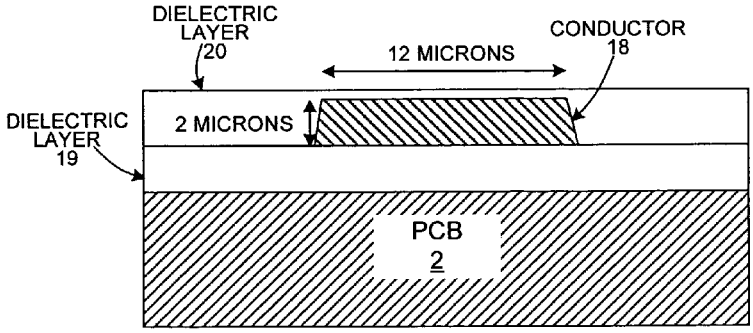
(PRIOR ART) FIG. 2
FIG. 2 is a simplified cross-sectional view of a typical signal conductor in the prior art.
Figure 3:
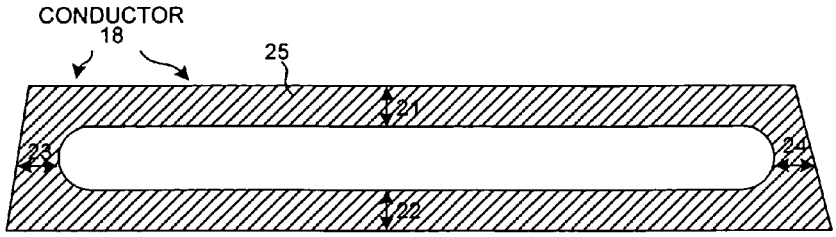
(PRIOR ART) FIG. 3
FIG. 3 is a simplified cross-sectional view of the conductive copper strip of FIG. 2, illustrating skin effect.
Figure 4:
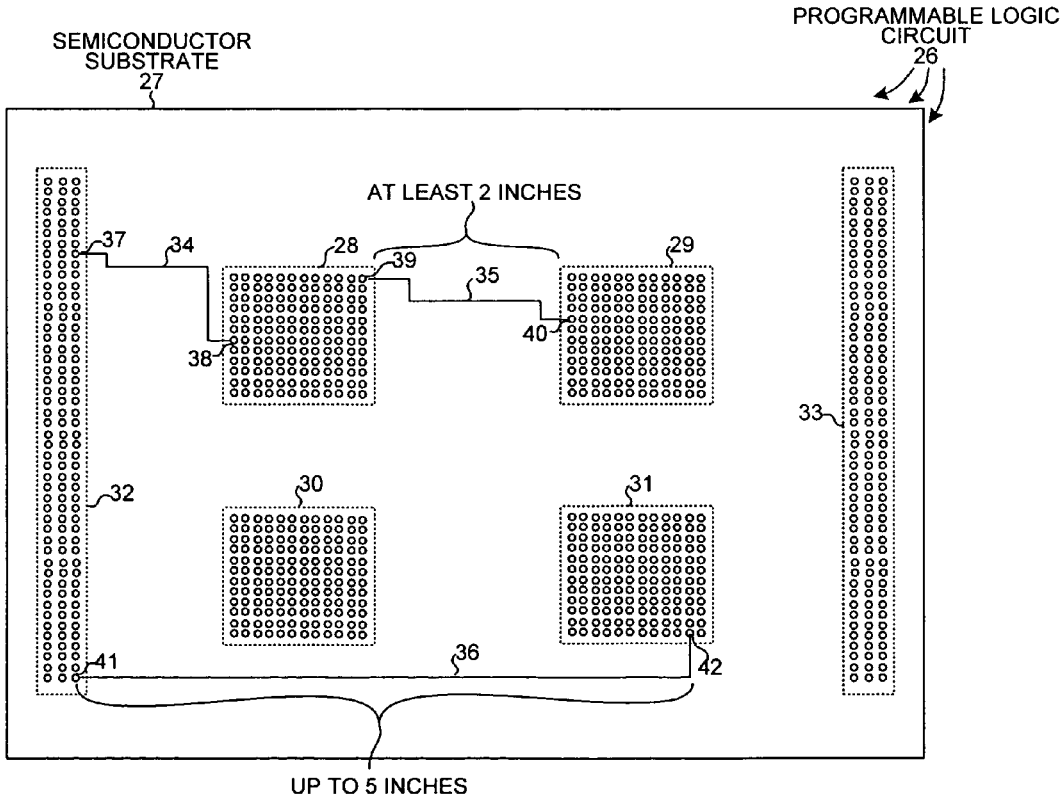
FIG. 4 is a simplified block diagram of a silicon substrate with FPGAs connected by multiple-layer signal conductors of up to five inches in length, in accordance with one novel aspect.

FIG. 4 is a simplified block diagram of a programmable logic circuit 26 with long signal conductors 34-36 in accordance with an exemplary embodiment of the present invention. Programmable logic circuit 26 includes a silicon semiconductor substrate 27 that is five inches on a side. Silicon semiconductor substrate 27 supports four Field-Programmable Gate Array (FPGA) chips 28-31 and two conductive connector strips 32-33. Three multiple-layer signal conductors 34-36 supported by the silicon semiconductor substrate are also illustrated. Multiple-layer signal conductors 34-36 are of conductive metal. Multiple-layer signal conductor 34 connects pad 37 at conductive connector strip 32 and pad 38 at FPGA 28. Multiple-layer signal conductor 35 connects pad 39 at FPGA 28 and pad 40 at FPGA 29. Multiple-layer signal conductor 35 is at least two inches long. Multiple-layer signal conductor 36 connects pad 41 at conductive connector strip 32 and pad 42 at FPGA 31. As is illustrated in FIG. 4, multiple-layer signal conductor 36 has a length of up to five inches.

Supporting substrate of programmable logic circuit 26 does not have to be a silicon semiconductor substrate. The multiple-layer signal conductor of the present invention may be used with other substrates, including PCB, flexible plastic substrates, flexible polyester substrates and ceramic substrates. In addition to FPGAs, the multiple-layer signal conductor of the present invention may be used to conduct signals between other devices, such as memories and processors. The multiple-layer signal conductor of the present invention may be a high-speed serial bus.

Figure 5:
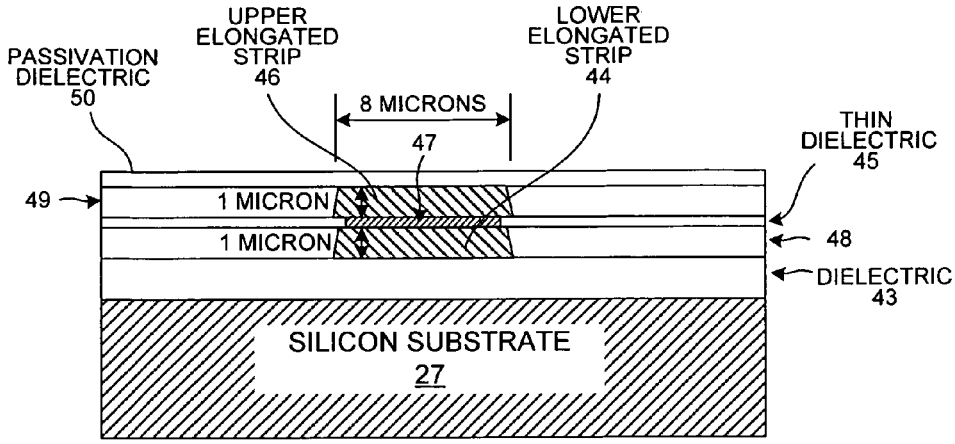
FIG. 5 is a simplified cross-sectional diagram of a multiple-layer signal conductor in accordance with one novel aspect.

FIG. 5 is a simplified cross-sectional diagram of multiple-layer signal conductor 36 of FIG. 4 according to one embodiment of the invention. The cross-sectional view shows example signal conductor 36 supported by the silicon semiconductor substrate 27. An insulating layer of dielectric 43 separates a first elongated strip of conductive material (or "lower conductor") 44 from silicon semiconductor substrate 27. A layer of dielectric 45 with a thickness of at least five hundred to six hundred nanometers separates the lower conductor 44 from a second elongated strip of conductive material (or "upper conductor") 46. In this embodiment, layer 45 is at least one skin effect depth, which for a ten gigahertz signal is about five to six hundred nanometers. A signal via 47 extending from the upper surface of the lower conductor 44 to the lower surface of the upper conductor 46 conductively connects the upper and lower conductors 44 and 46. Additional layers of dielectric 48 and 49 extend from the vertical edges of lower conductor 44 and upper conductor 46. A layer of passivation dielectric 50 covers the upper surfaces of upper conductor 46 and additional layer of dielectric 49. Upper conductor 46, lower conductor 44, and signal via 47 may be of a conductive metal, such as copper.

Signals are driven onto one or both conductors 44 and 46. Because the upper conductor 46 and lower conductor 44 are conductively connected by multiple signal vias 47, each conductor 44 and 46 conducts the same signal, thereby forming a single signal conductor 36. Signals are driven between conductive connector strip 32 and FPGA 31 through the multiple-layer signal conductor 36 at a speed of ten gigahertz or greater, with a corresponding digital signal rise time of thirty picoseconds. Because signal conductor 36 may be up to five inches in length, the ratio of signal propagation delay to signal rise time can give rise to reflections.

Each of upper conductor 46 and lower conductor 44 of the illustrated embodiment has a width of eight microns and a thickness of one micron. In other embodiments, conductors in multiple-layer signal conductors may be as narrow as one micron or as wide as twenty microns. Skin effect at such signal transmission speeds is on the order of five hundred or six hundred nanometers. The effective cross-sectional area of the signal trace thus extends five hundred or six hundred nanometers upward from the lower surface of each conductor, and 500 or 600 nanometers downward from the upper surface of each conductor. Due to skin effect at signal speeds of ten gigahertz, signal conductors having a thickness much greater than one micron would not reduce the effective resistance of the transmission line. Instead, an additional layer of signal conductor doubles the effective cross-sectional conductive area of the multiple-layer signal conductor with respect to a given thickness of metal conductor.

Figure 6:
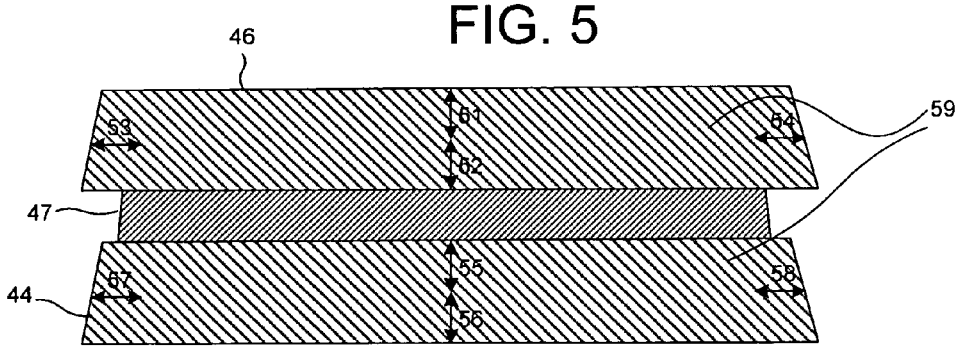
FIG. 6 is a simplified cross-sectional view of the conductive portions of FIG. 5, illustrating skin effect in a multiple-layer signal conductor.

FIG. 6 is an expanded cross-sectional diagram of the multiple-layer signal conductor 36 of FIGS. 4 and 5 indicating the effective cross-sectional area due to skin effect. Shown are the upper conductor 46, the lower conductor 44, and a signal via 47. Arrows 51 indicate the skin depth at which current concentrates near the upper surface of upper conductor 46 during high-speed signaling. Arrows 52 indicate the skin depth at which current concentrates near the lower surface of upper conductor 46 during high-speed signaling. Arrows 53 and 54 indicate the skin depth at which current concentrates near the vertical edges of upper conductor 46 during high-speed signaling. Arrows 55 indicate the skin depth at which current concentrates near the upper surface of lower conductor 44 during high-speed signaling. Arrows 56 indicate the skin depth at which current concentrates near the lower surface of lower conductor 44 during high-speed signaling. Arrows 57 and 58 indicate the skin depth at which current concentrates near the vertical edges of lower conductor 44 during high-speed signaling. Patterned area 59 indicates the effective cross-sectional conductive area of the multiple-layer signal conductor due to skin effect.

Figure 7:
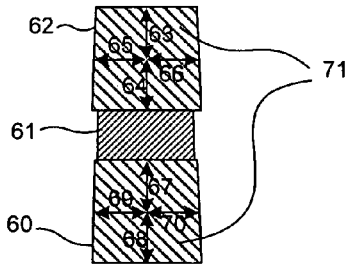
FIG. 7 is a simplified cross-sectional view of the conductive portions of a multiple-layer signal conductor with a width of one micron, illustrating skin effect in accordance with one novel aspect.

Depending on the application, strips of conductive material in a multiple-layer signal conductor may be made narrower or wider. FIG. 7 is an expanded cross-sectional diagram of a section of multiple-layer high-speed transmission line 35 according to another embodiment of the invention. Upper conductor 62 and lower conductor 60 each have a thickness of one micron and a width of one micron. Signal via 61 conductively connects upper conductor 62 and lower conductor 60. Arrows 63 indicate the skin depth at which current concentrates near the upper surface of upper conductor 62 during high-speed signaling. Arrows 64 indicate the skin depth at which current concentrates near the lower surface of upper conductor 62 during high-speed signaling. Arrows 65 and 66 indicate the skin depth at which current concentrates near the vertical edges of upper conductor 62 during high-speed signaling. Arrows 67 indicate the skin depth at which current concentrates near the upper surface of lower conductor 60 during high-speed signaling. Arrows 68 indicate the skin depth at which current concentrates near the lower surface of lower conductor 60 during high-speed signaling. Arrows 69 and 70 indicate the skin depth at which current concentrates near the vertical edges of lower conductor 60 during high-speed signaling. Patterned area 71 indicates the effective cross-sectional conductive area of the multiple-layer signal conductor due to skin effect. Such an embodiment results in lower parasitic capacitance to ground planes, power planes, and other signal conductors when compared with embodiments using wider signal conductors.

Figure 8:
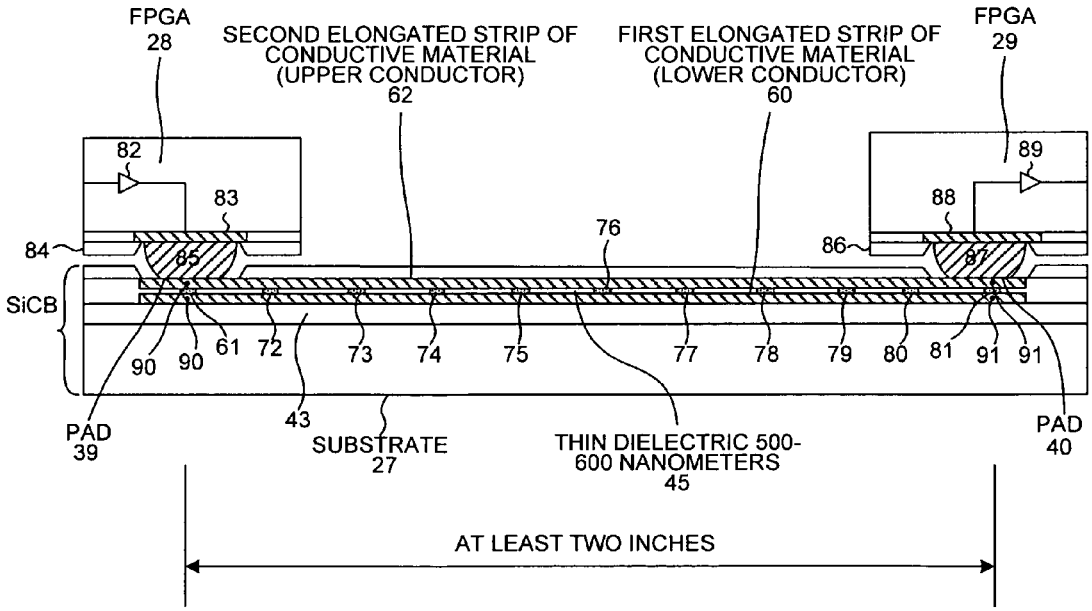
FIG. 8 is a simplified cross-sectional diagram of a multiple-layer signal conductor connecting FPGAs in accordance with one novel aspect.

FIG. 8 is a simplified cross-sectional diagram of multiple-layer signal conductor 35 of FIG. 4 in accordance with one novel aspect. Silicon semiconductor substrate 27 supports FPGAs 28 and 29 and multiple-layer signal conductor 35. Multiple-layer signal conductor 35 includes first elongated strip of conductive material (the lower conductor) 60 and second elongated strip of conductive material (the upper conductor) 62 separated by layer of dielectric 45 with a thickness of five hundred to six hundred nanometers. Second elongated strip of conductive material is disposed over and parallel to first elongated strip of conductive material. Signal vias 61 and 72-81 extending from the upper surface of the lower conductor 60 to the lower surface of the upper conductor 62 conductively connect upper conductor 62 and lower conductor 60. Signal vias 61 and 72-81 are regularly spaced each four or five millimeters along the length of the multiple-layer signal conductor 35. Signal via 61, at point 90, is separated from signal via 81, at point 91, by at least two inches. Multiple-layer signal conductor 35 is unterminated.

FPGA 28 is separated from silicon semiconductor substrate 27 and multiple-layer signal conductor 35 by a layer of passivation dielectric 84. Bond ball 85 of conductive material conductively connects the lower surface of conductor 83 to the upper surface of the upper conductor 62 of multiple-layer signal conductor 35 at pad area 39. Signal driver 82 drives signals from FPGA 28 onto multiple-layer signal conductor 35.

Similarly, FPGA 29 is separated from silicon semiconductor substrate 27 and multiple-layer signal conductor 35 by a layer of passivation dielectric 86. Bond ball 87 of conductive material conductively connects the lower surface of conductor 88 to the upper surface of the upper conductor 62 of multiple-layer signal conductor 35 at pad area 40. Signal receiver 89 receives signals from FPGA 28 via multiple-layer signal conductor 35.

Signals from FPGA 28 are driven by signal driver 82 onto the upper surface of upper conductor 62 of multiple-layer signal conductor 35 via bond ball 85. Signals are then conducted along upper conductor 62 of multiple-layer signal conductor 35. Signals are conducted to the lower conductor 60 of multiple-layer signal conductor 35 by the regularly spaced signal vias 61 and 72-81 such that signals are driven simultaneously along both upper conductor 62 and lower conductor 60. Signals are conducted to FPGA 29 from the upper surface of upper conductor 62 via bond ball 87. Signals are then received by receiver 89.

Figure 9:
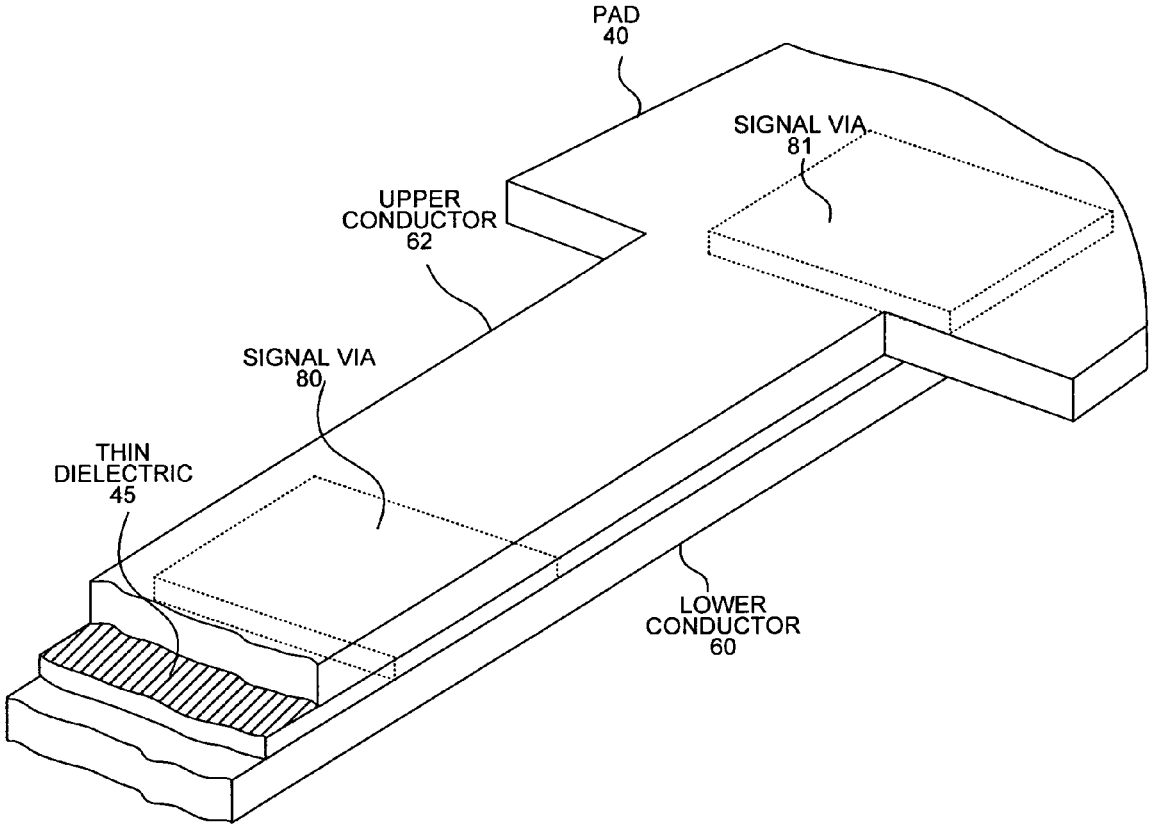
FIG. 9 is a simplified perspective diagram of a multiple-layer signal conductor in accordance with one novel aspect.

FIG. 9 is a simplified perspective diagram of a section of the multiple-layer signal conductor 35 of FIG. 8 in accordance with one novel aspect. Illustrated are upper conductor 62 and lower conductor 60 separated by a thin layer of dielectric 45. Signal vias 80 and 81 conductively connect the upper surface of lower conductor 60 to lower surface of upper conductor 62. Signal vias 80 and 81 extend approximately the width of upper and lower conductors 62 and 60 and are spaced approximately four or five millimeters apart. Also illustrated is a widened pad area 40 of upper conductor 62.

Figure 10:
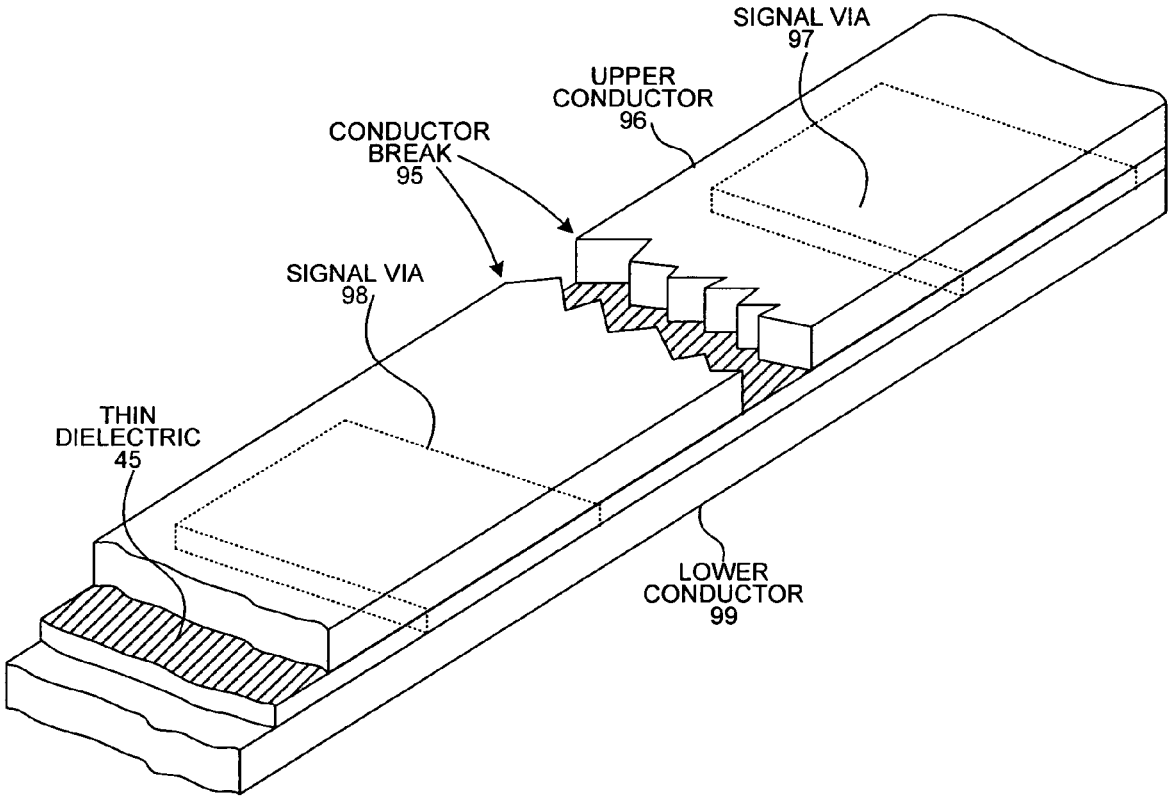
FIG. 10 is a simplified perspective diagram of a line break in one layer of a multiple-layer signal conductor in accordance with one novel aspect.

FIG. 10 is a simplified perspective view of a section of the multiple-layer signal conductor 34 of FIG. 4 in accordance with one novel aspect. The illustrated section of multiple-layer signal conductor 34 includes a conductor break 95 in the upper conductor 96. A conductor can break due to the mechanical stress caused by the difference in thermal expansion coefficient between the material of the conductor and the supporting substrate. Because signal vias 97 and 98 conductively connect the upper surface of lower conductor 99 to lower surface of upper conductor 96, signals driven along the upper conductor 96 are conducted around the conductor break 95 through signal via 97, along lower conductor 99, though signal via 98, and back to upper conductor 96.

Figure 11:
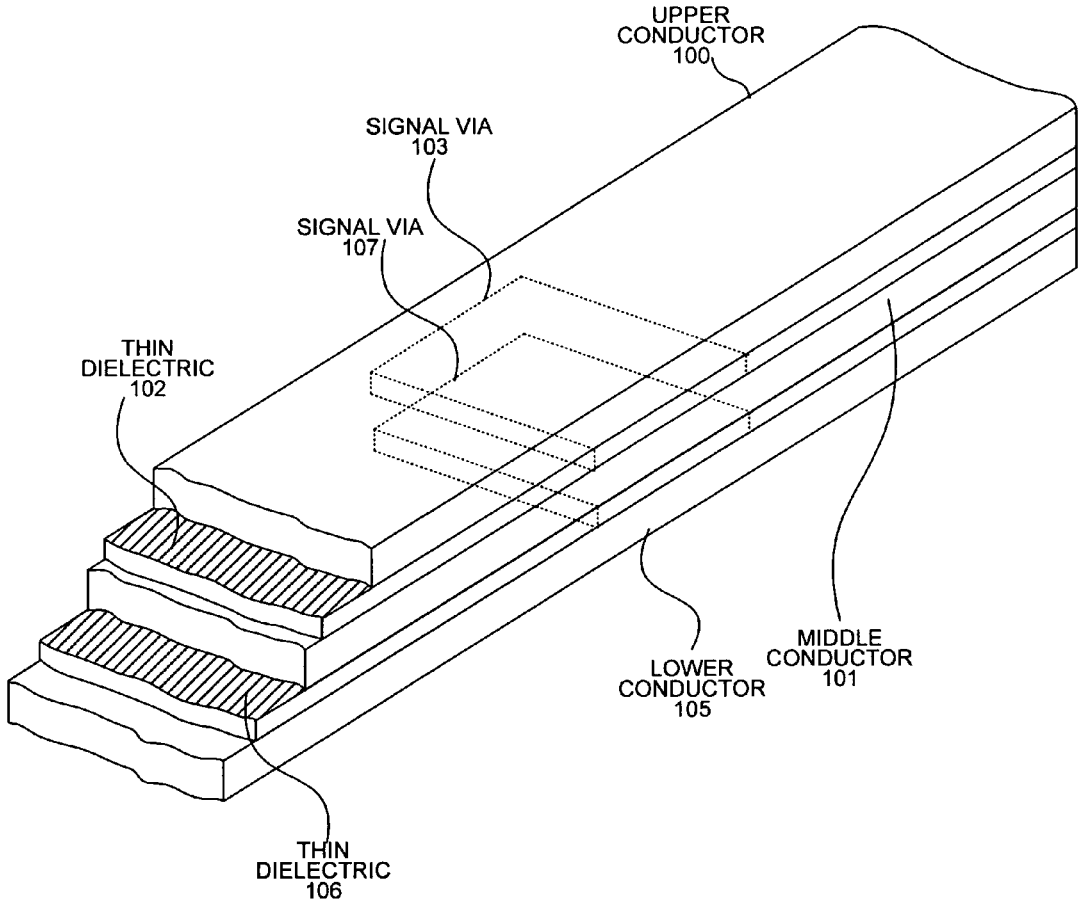
FIG. 11 is a simplified perspective diagram of a multiple-layer signal conductor with an additional layer in accordance with one novel aspect.

FIG. 11 is a simplified perspective diagram of a section of a multiple-layer signal conductor in accordance with another embodiment of the invention. Three strips of conductive material 100 101 and 105 are connected by signal vias are illustrated. An upper conductor 100 and a middle conductor 101 are separated by a thin layer of dielectric 102. Signal via 103 conductively connects the upper surface of middle conductor 101 to lower surface of upper conductor 100. Middle conductor 101 and a lower conductor 105 are separated by an additional thin layer of dielectric 106. Signal via 107 conductively connects the upper surface of lower conductor 106 to lower surface of middle conductor 101. Because the conductors 100 101 and 105 are conductively connected by signal vias 103 and 107, each conductor conducts the same signal, thereby forming a single signal conductor.

Figure 12:
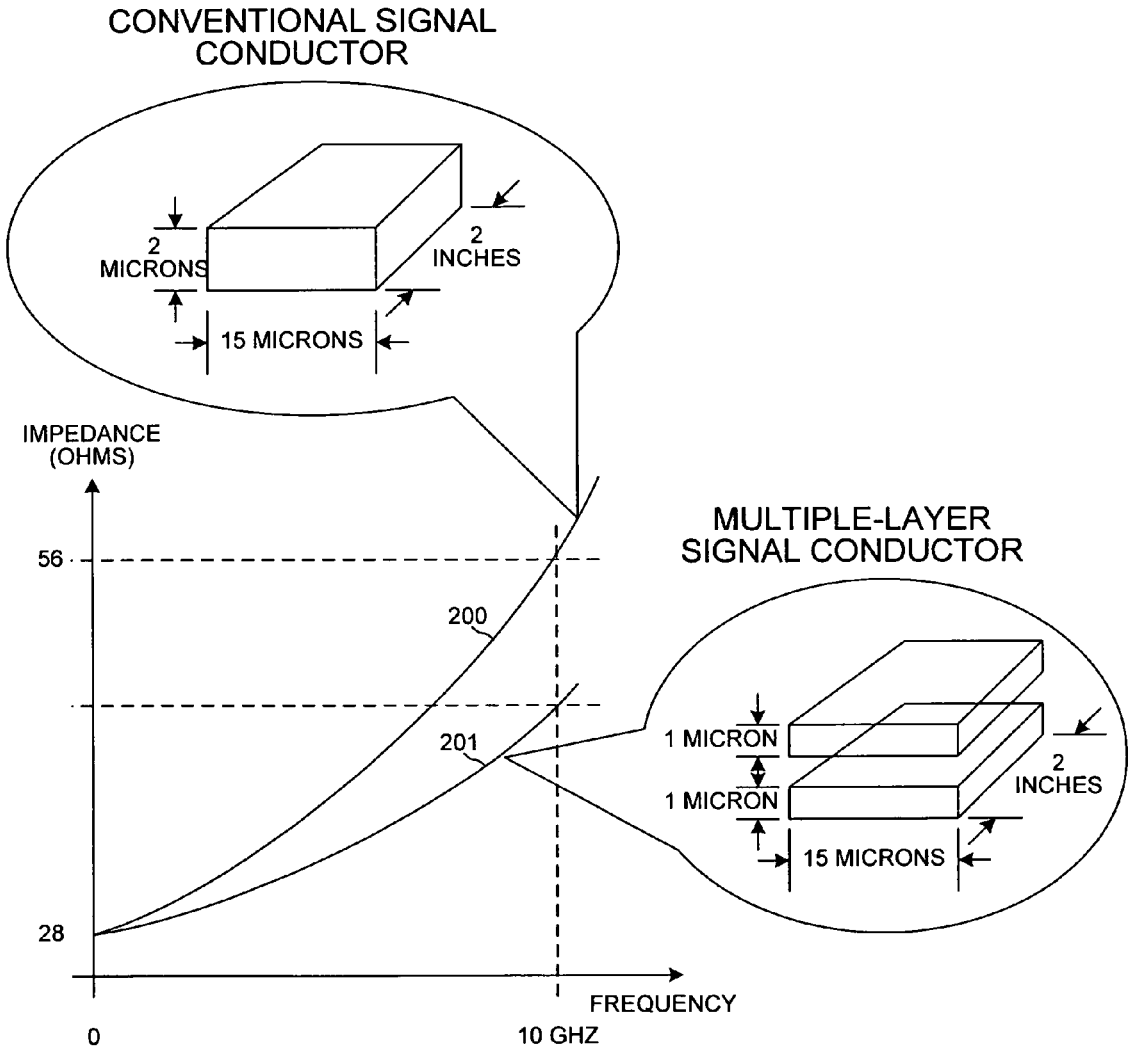
FIG. 12 is a diagram that illustrates how a multiple layer signal conductor reduces the change in characteristic impedance as a function of frequency when compared to a conventional single layer signal conductor. The conventional and multiple-layer signal conductors being compared have identical cross-sectional areas of conductive material.

FIG. 12 is a diagram that illustrates how a multiple layer signal conductor reduces the change in characteristic impedance as a function of frequency when compared to a conventional single layer signal conductor. The conventional and multiple-layer signal conductors being compared have identical cross-sectional areas of conductive material. Line 200 shows how the impedance of a conventional signal conductor changes with frequency. Line 201 shows how the impedance of a multiple-layer signal conductor changes with frequency. The effective resistance of the conductor has a similar relationship with respect to frequency due to reduction in the skin effect.

Figure 13:
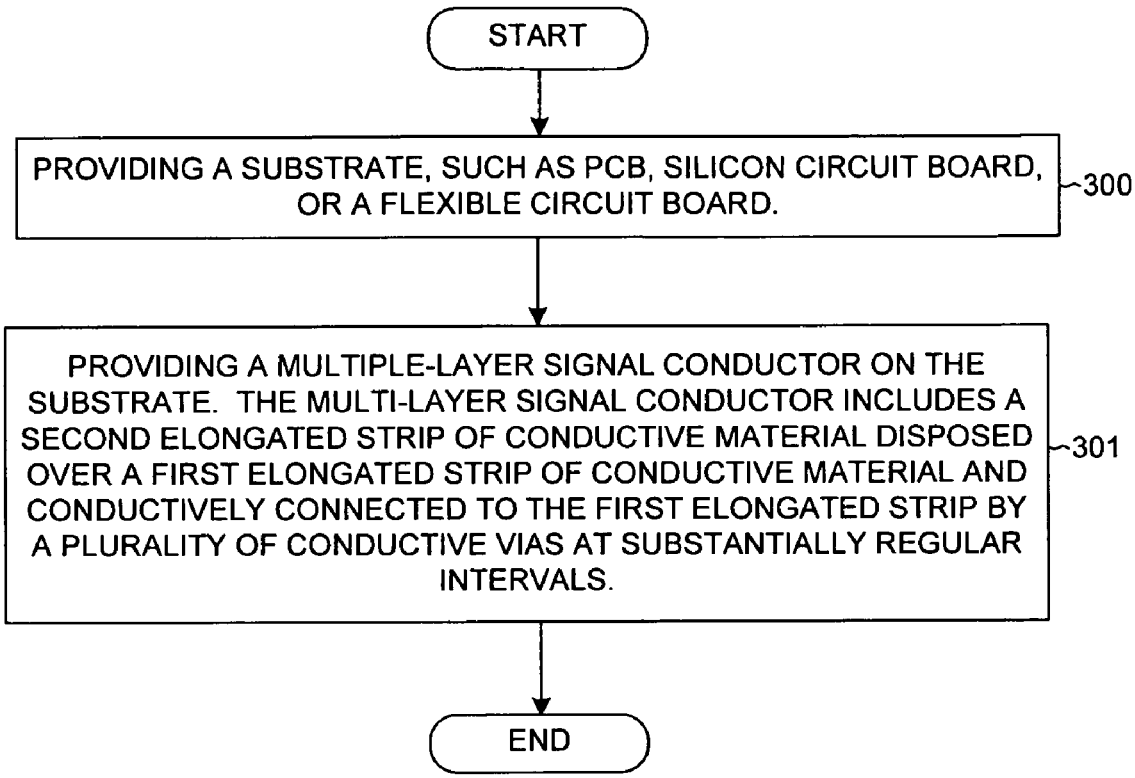
FIG. 13 is a simplified flowchart of a method of providing a multiple-layer signal conductor in accordance with one novel aspect.

FIG. 13 is a flow chart of a method of fabricating a multiple-layer signal conductor in accordance with one novel aspect. In Step 300, a substrate, such as a printed circuit board (PBC), semiconductor silicon substrate, flexible substrate or ceramic substrate is provided. In Step 301, a multi-layer signal conductor is provided on the substrate. The multi-layer signal conductor includes a second elongated strip of conductive material that has an average width of less than approximately fifteen microns and a length of at least two inches disposed over a second elongated strip of conductive material that has an average width of less than approximately fifteen microns and a length of at least two inches. The multi-layer signal conductor also includes a plurality of conductive vias that conductively connect the first and second elongated strips at substantially regular intervals.

Although certain specific embodiments are described above for instructional purposes, the teachings of this patent document have general applicability and are not limited to the specific embodiments described above. The multiple-layer signal conductor that mitigates increases in resistance due to the skin effect at high frequencies can be incorporated into printed circuit boards, integrated circuits, and flexible printed circuits, as well as into silicon circuit boards. Accordingly, various modifications, adaptations, and combinations of various features of the described embodiments can be practiced without departing from the scope of the invention as set forth in the claims.

What is claimed is:

1. An apparatus comprising:

a first elongated strip of conductive material, wherein a first point on the first elongated strip is separated from a second point on the first elongated strip by a length of at least two inches, wherein the first elongated strip has an average width of less than approximately fifteen microns;

a second elongated strip of conductive material, wherein a first point on the second elongated strip is separated from a second point on the second elongated strip by a length of at least two inches, wherein the second elongated strip is disposed over the first elongated strip, and wherein the second elongated strip extends parallel to the first elongated strip, wherein the second elongated strip has an average width of less than approximately fifteen microns;

a layer of dielectric material disposed between the first elongated strip and the second elongated strip;

a first conductive via connecting the first point on the first elongated strip to the first point on the second elongated strip;

a second conductive via connecting the second point on the first elongated strip to the second point on the second elongated strip; and a substrate that supports the first and second elongated strips, and wherein the substrate is taken from the group consisting of: a substrate that includes fiberglass, a semiconductor substrate, a flexible insulative substrate material, and a ceramic substrate.

2. The apparatus of claim 1, wherein the second elongated strip includes a conductive land portion.

3. The apparatus of claim 1, wherein the first and second elongated strips are metal conductors.

4. The apparatus of claim 1, wherein the first elongated strip has a thickness of less than two microns, and wherein the second elongated strip has a thickness of less than two microns.

5. The apparatus of claim 1, wherein the distance between the first conductive via and the second conductive via is at least two inches.

6. The apparatus of claim 1, wherein the first elongated strip is unterminated, and wherein the second elongated strip is unterminated.

7. The apparatus of claim 1, wherein the layer of dielectric has a thickness of at least five hundred nanometers.

8. The apparatus of claim 1, wherein the first elongated strip and the second elongated strip form a signal conductor, wherein the signal conductor is part of a high-speed serial bus coupled to a Field Programmable Gate Array (FPGA).

9. The apparatus of claim 1, wherein the first elongated strip and the second elongated strip together form a signal conductor, and wherein an output lead of a signal driver is coupled to drive a signal onto the signal conductor.

10. The apparatus of claim 1, wherein the first elongated strip and the second elongated strip conduct a signal having a rise time of less than two hundred picoseconds.

11. The apparatus of claim 10, wherein the first elongated strip and the second elongated strip together form a signal conductor, wherein the signal conductor has a resistance of greater than ten ohms at zero hertz, and wherein the signal conductor has an effective resistance of less than fifty ohms at ten gigahertz.

12. An apparatus comprising:

a substrate taken from the group consisting of: a substrate that includes fiberglass, a semiconductor substrate, a flexible insulative substrate material, and a ceramic substrate; and means disposed on the substrate for communicating a signal a distance of at least two inches, wherein the means has a characteristic resistance of greater than ten ohms at zero hertz, and wherein the means has an effective resistance of less than fifty ohms at ten gigahertz.

13. The apparatus of claim 12, wherein the apparatus is a silicon circuit board.

14. A method comprising:

providing a substrate; and providing a multi-layer signal conductor on the substrate, wherein the multi-layer signal conductor includes a first elongated strip of conductive material that has an average width of less than approximately fifteen microns and a length of at least two inches, a second elongated strip of conductive material that has an average width of less than approximately fifteen microns and a length of at least two inches, and a plurality of conductive vias that conductively connect the first and second elongated strips at substantially regular intervals.

15. The method of claim 14, wherein the substrate is a semiconductor substrate.

16. The method of claim 14, wherein the second elongated strip extends over and parallel to the first elongated strip.

17. The method of claim 14, wherein the first elongated strip has a thickness of less than two microns, and wherein the second elongated strip has thickness of less than two microns.

18. The method of claim 14, wherein the vias of the plurality of conductive vias are distributed along the first and second elongated strips such that there is at least one via in each six millimeter section of the multi-layer signal conductor.

19. The method of claim 14, wherein the multi-layer signal conductor is unterminated.

20. The method of claim 14, wherein the multi-layer signal conductor and substrate are parts of a silicon circuit board.

* * * * *